US005160477A

United States Patent [19]

Foulard

[11] Patent Number: 5,160,477

[45] Date of Patent: Nov. 3, 1992

[54] TEMPERATURE MAINTENANCE AND METALLURGICAL TREATMENT FURNACE

[75] Inventor: Jean Foulard, Ablon, France

[73] Assignee: L'Air Liquide, Societe Anonyme pour l'Etude et l'Exploitation des Procedes Georges Claude, Paris, France

[21] Appl. No.: 727,240

[22] Filed: Jul. 9, 1991

[30] Foreign Application Priority Data

Jul. 13, 1990 [FR] France ..... 90 08959

[51] Int. Cl.[5] ..... C21C 5/48; C21C 5/50

[52] U.S. Cl. ..... 266/99; 266/144; 266/220; 266/248

[58] Field of Search ..... 266/99, 173, 213, 220, 266/227, 233, 236, 248, 900, 901, 144

[56] References Cited

U.S. PATENT DOCUMENTS

| | | | |
|---|---|---|---|
| 3,525,506 | 8/1970 | Harry, Jr. et al. | 266/207 |
| 4,004,793 | 1/1977 | Gray | 266/236 |
| 4,245,821 | 1/1981 | Kappell et al. | 266/213 |
| 4,701,216 | 10/1987 | Spenceley et al. | 75/583 |

FOREIGN PATENT DOCUMENTS

| | | |
|---|---|---|
| 0217094 | 4/1987 | European Pat. Off. . |
| 1042052 | 10/1953 | France . |
| 113834 | 4/1918 | United Kingdom . |

OTHER PUBLICATIONS

"Hundert Jahre Roheisenmisher", Stahl U. Eisen, vol. 93, No. 16, Aug. 2, 1973, pp. 732–740, by G. Schmidt.

"Torpedo Ladle Having Powder Blowing Device", Patents Abstracts of Japan, vol. 10, No. 235 (C-366), Aug. 14, 1986.

*Primary Examiner*—Melvyn J. Andrews

*Attorney, Agent, or Firm*—Young & Thompson

[57] ABSTRACT

Temperature maintenance and metallurgical treatment furnace for a metal in liquid state, comprising a closed container for liquid metal provided with a burner of the oxygen-combustible type, a porous plug for the bottom of the container for injecting a neutral stirring gas, and openings for the introduction and/or the removal of metallurgical treatment products. The container is in the form of an insulated enclosure which is rockable about a support axis, with two ducts with vertical component, one which is in the form of a chimney opening in the enclosure close to the vault of the enclosure and serving for the introduction of liquid metal and metallurgical treatment products, the other which is in the form of a chute opening at the level of the bottom of the enclosure and in which the upper opening is in position of liquid metal removal in a rocked position of the enclosure. The burner is mounted in the vault of the enclosure.

12 Claims, 2 Drawing Sheets

L
A
II
II
X
Y
1
2
3
4
5
6
12
14
15
17
N
f

I
17
11
9
7
2
12
16
N1
X-Y
10
8
f'
1
14
F
I
I

TEMPERATURE MAINTENANCE AND METALLURGICAL TREATMENT FURNACE

BACKGROUND OF THE INVENTION

1. Field of the Invention

The present invention concerns a temperature maintenance and metallurgical treatment furnace for a metal in liquid state.

2. Description of Prior Art

The problem of storing and maintenance of the temperature of a liquid metal arises in many metallurgical plants and, nearly systematically, in foundries of medium importance.

It has been proposed to use for this purpose mixers in the form of ladles lined with refractories and provided with an air-combustible burner to store the liquid metal at its outlet from the smelting apparatus and try to limit the decrease of temperature before its later use. Because of their very limited efficiency, nearly all apparatuses have been replaced by induction furnaces, of the hearth type for medium capacities, with channels for the most important ones, but in the smelting of cast iron, the investment and operation costs of the induction furnaces are very substantial.

In steel metallurgy, this problem was resolved by developing a ladle furnace heated with an electric arc.

Two variants utilizing oxygen as fuel have however been tried:

According to one of these variants, an operation of aluminothermy is directly carried out in the ladle and it consists of an addition of aluminum to the metal, then an injection of oxygen followed by a stirring for homogenizing and decanting the liquid metal by means of argon. This process, although used on an industrial basis, enables to heating up the metal, but does not permit any metallurgical treatment.

According to another variant, a maintenance furnace has been produced in the form of the traditional metallurgical ladle, which has been provided with an oxycombustible burner, mounted across a ladle cover, and a bottom porous plug, all in a manner to permit a good heat transfer. This design is however extremely rudimentary, and it leads to important heat losses and also does not permit the use of metallurgical treatments.

SUMMARY OF INVENTION

It is an object of the present invention to provide a temperature maintenance and metallurgical treatment furnace for a metal in liquid state, of the type comprising a closed container for liquid metal, provided with an oxygen or air enriched fuel burner and a container bottom porous plug for the injection of a neutral stirring gas, and means for opening said container for the introduction and/or the removal of metallurgical treatment products, which enables not only to limiting the temperature decrease but also enables some warming up of the liquid metal and even additional treatments, and which, in addition to storing and warming the metal, enables to adjusting or modifying the chemical composition of the latter and possibly to causing it to react with other elements such as a slag for example and these objects of the invention are achieved by designing the container in the form of an insulated enclosure which is mounted with restricted rocking around a support axis, having two ducts with vertical component, one in the form of a chimney opening into the enclosure near the vault of the enclosure and used for the introduction of liquid metal and metallurgical treatment products, the other being in the form of a chute opening at the level of the bottom of the enclosure and whose upper opening may be in low position for the removal of liquid metal in a rocked position of said enclosure, the oxygen-combustible burner being mounted in the vault of the enclosure.

In this manner, the enclosure is nearly completely closed, which simplifies the operation and prevents important heat losses, while enabling metallurgical treatment operations, such as the introduction of the reactants. The argon or nitrogen neutral gas which is blown through the bottom enables a thermic and metallurgical homogenization.

Advantageously, any one of the following possibilities may be used:

- a lateral inspection door may be arranged in high position, enabling to easily carrying out all types of additions and the withdrawal of any floating slag;
- the introduction duct is mounted at one end of the enclosure, while the withdrawing duct for liquid metal is disposed at an opposite end of said enclosure;
- the vault burner is located beside the withdrawing duct, which enables dispensing the maximum heat energy on the side where there is a risk of plugging by solidification;
- there are provided a plurality of porous plugs arranged from the end of the enclosure located on the side of the introduction duct to the end of the enclosure located on the side of the withdrawing duct;
- preferably, the inspection door is located between the burner and the introduction duct;
- the rocking axis extends from the end near the introduction duct to the end near the withdrawing duct;
- preferably, the enclosure is in the form of a cylinder with a horizontally arranged longitudinal axis and, in this case, the enclosure which is in the form of a cylinder is rockably mounted around the horizontal axis of the cylinder;
- the porous plugs are inclined with respect to the vertical in opposite directions with respect to the inspection door, which promotes the slag formation and improves heat transfer when the oven is rocked;
- one of the porous plugs is mounted at the level of the outlet end of the withdrawing duct;
- the ratio between the length of the cylinder and its diameter is between 1.3 and 1.9, and preferably of the order of 1.6.

BRIEF DESCRIPTION OF DRAWINGS

The characteristics and advantages of the invention will appear from the description which follows by way of example with reference to the annexed drawings in which.

DESCRIPTION OF PREFERRED EMBODIMENT

Figure 1:
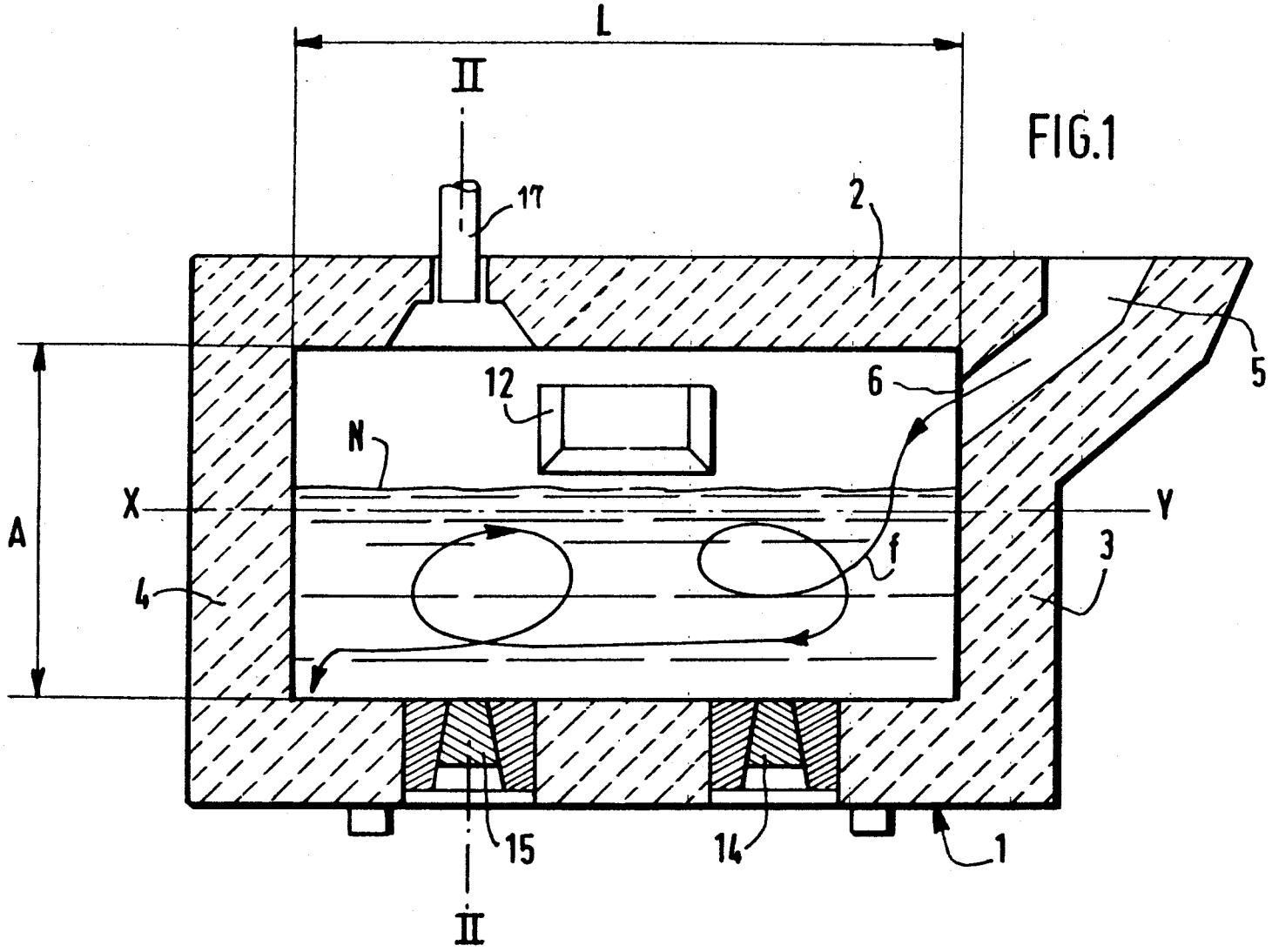
FIG. 1 is a longitudinal cross-sectional view of the oven according to line I—I of FIG. 2.
Figure 2:
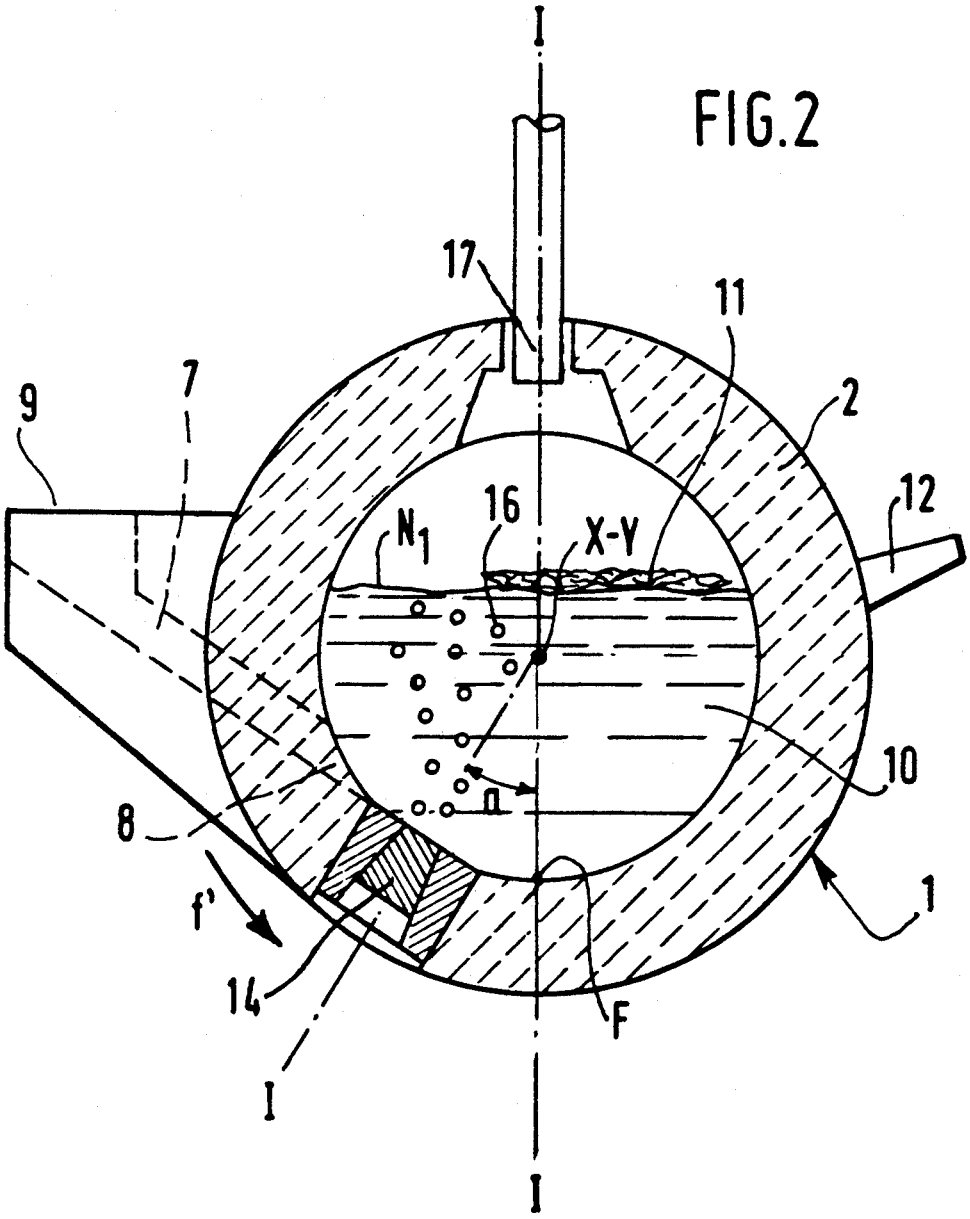
FIG. 2 is a transverse cross-section of the same according to line II—II of FIG. 1.

With reference to FIGS. 1 and 2, a furnace is shown in the form of a cylindrical enclosure 1 with a cylindrical sheath 2 and two end walls 3 and 4, of refractory material, possibly with an additional insulation. This cylindrical enclosure is designed so that the ratio between the axial length L and its diameter D is between 1.4 and 1.8 and preferably of the order of 1.6, on the one hand to limit the losses through the walls and on the other hand, to minimize the variations of the height of the liquid metal.

This cylindrical enclosure 1 is mounted on a horizontal rocking axis XY according to the axis of the cylinder. At one axial end of the cylinder 1 there is provided a duct for the introduction of liquid metal 5, the duct being in, the form of a chimney extending through the end wall 3 and opening into the furnace at 6 at an upper level of the furnace. A second duct 7 is formed, in the vicinity of the other end wall 4, by means of a lateral extension of refractory material which opens tangentially at 8 into the internal wall of the enclosure 1, and, in operating position -position shown in FIG. 2- it rises to open at 9 at a level which is higher than the maximum level $N_1$ of the liquid metal 10. Between the end walls 3 and 4 of the enclosure there is provided an inspection door 12 also defining an access duct for the removal of the slag which possibly floats as shown at 11 in FIG. 2.

At least two porous plugs 14 and 15 are provided in low position through the cylindrical wall of the enclosure 2, one, 14 being closer to the end wall 3, the other, 15 being closer to the end wall 4, for the injection of a stirring gas such as argon, and these porous plugs 14 and 15 are inclined with at an angle a with respect to the bottom line F, to be flush with the opening 8 of the withdrawing duct 7. There is thus produced an accentuated turbulence at the level of this opening 8, which prevents any risk of solidification on the one hand, and, on the other hand, ensures a pneumatic propulsion, by means of the bubbles 16, of the floating slag 11 towards the inspection door 12, which enables its easy removal.

A burner 17 of the oxygen-combustible type, which is vertically adjustable, is mounted at an upper location or vault of the cylindrical wall 2 of the enclosure 1 and it is longitudinally located closer to the end wall 4 than to the end wall 3, at a substantial angle to the duct 7, so as to ensure a preferential heating, on the evacuation side, of the liquid metal and also to increase the time of residence of the hot gas before its escape through the chimney-duct 5, which improves the heat transfer towards the metallic mass. It will be understood that during the treatment, the metal introduced in duct 5 flows in the direction of arrow f (FIG. 1) longitudinally towards the outlet end 8, while being stirred by the neutral gas which is blown therein by means of the porous plugs 14 and 15.

At the end of the waiting period or treatment, the enclosure 1 is rocked according to arrow f' to bring the withdrawing channel 7 in lower position.

Various modifications may be made, such as to improve heat transfer towards the molten metal. One of these modifications consists in mounting the burner so as to be movable along a vertical axis, so as to determine its position depending on the level of molten metal. Also, a refractory valve may advantageously be disposed on the chimney-duct 5, which permits operating the furnace at a slight over-pressure, and thus improves heat transfer.

We claim:

1. A furnace for refining and maintaining the temperature of a metal in a molten state, comprising an insulated enclosure defining an inner chamber and having a vault portion, a bottom portion and first and second opposite ends which lie on a main axis of the enclosure, the enclosure being rockable around the main axis between an operative position and a tilted position, the enclosure being formed at said first end with a first upwardly extending duct serving as a gas-exhausting chimney and as a means for introducing liquid metal into the chamber, said first duct opening into the chamber at a location below the vault portion, the enclosure having adjacent said second end a second duct that extends upwardly to the level of said vault portion when said enclosure is in said operative position and that serves as a molten metal discharging means when the enclosure is in said tilted position, the second duct opening into the chamber adjacent said bottom portion, at least one porous plug in said bottom portion for injecting a neutral stirring gas into the chamber, and at least one burner in the vault portion for burning a mixture of a combustible gas and an oxygen-containing gas.

2. The furnace of claim 1, said enclosure having first and second lateral portions that lie on opposite sides of a vertical plane containing said main axis when said enclosure is in said operative position, further comprising an inspection door in said first lateral portion of the enclosure.

3. The furnace of claim 2, wherein said second duct is in said second lateral portion of the enclosure.

4. The furnace of claim 3, wherein the burner is located adjacent said second end of the enclosure.

5. The furnace of claim 4, wherein the inspection door is located intermediate the burner and the first duct relative to said main axis.

6. The furnace of claim 5, wherein said at least one porous plug is in said second lateral portion of the enclosure.

7. The furnace of claim 6, comprising at least two said porous plugs substantially along a line parallel to the main axis.

8. The furnace of claim 7, wherein one porous plug is arranged adjacent the opening of the second duct into the chamber.

9. The furnace of claim 1, wherein the enclosure is substantially cylindrical, the main axis being horizontal.

10. The furnace of claim 9, wherein the burner is adjustable vertically in the vault portion.

11. The furnace of claim 5, wherein the burner is adjustable vertically in the vault portion.

12. The furnace of claim 1, said enclosure having first and second lateral portions that lie on opposite sides of a vertical plane containing said main axis when said enclosure is in said operative position, said second duct opening into said second lateral portion of the enclosure and said at least one porous plug being disposed in said second lateral portion of the enclosure.

* * * * *